US008038113B2

(12) United States Patent
Fryzek et al.

(10) Patent No.: US 8,038,113 B2
(45) Date of Patent: Oct. 18, 2011

(54) TELESCOPING MOUNTING SYSTEM FOR A RECESSED LUMINAIRE

(75) Inventors: Aaron P. Fryzek, Wheaton, IL (US); Kerry Collins, Island Lake, IL (US)

(73) Assignee: Juno Manufacturing, LLC, Des Plaines, IL (US)

( * ) Notice: Subject to any disclaimer, the term of this patent is extended or adjusted under 35 U.S.C. 154(b) by 27 days.

(21) Appl. No.: 12/726,956

(22) Filed: Mar. 18, 2010

(65) Prior Publication Data

US 2011/0226919 A1 Sep. 22, 2011

(51) Int. Cl.
*B42F 13/00* (2006.01)

(52) U.S. Cl. ..... 248/343; 248/906; 362/406

(58) Field of Classification Search ..... 248/343, 248/342, 906, 200.1; 174/52; 362/148, 147, 362/404, 405, 406, 457
See application file for complete search history.

(56) References Cited

U.S. PATENT DOCUMENTS

| | | | | |
|---|---|---|---|---|
| 5,045,985 | A * | 9/1991 | Russo et al. | 362/366 |
| 6,484,979 | B1 * | 11/2002 | Medlin, Jr. | 248/205.1 |
| 6,889,943 | B2 | 5/2005 | Dinh et al. | 248/34 |
| 7,216,838 | B1 * | 5/2007 | Gretz | 248/200.1 |
| 7,874,539 | B2 * | 1/2011 | Wright et al. | 248/547 |
| 2007/0272816 | A1 * | 11/2007 | Friederich et al. | 248/343 |
| 2008/0296460 | A1 * | 12/2008 | Kerr, Jr. | 248/343 |

* cited by examiner

*Primary Examiner* — Ramon Ramirez

(57) ABSTRACT

A lighting assembly for a recessed luminaire includes a plaster frame for supporting the recessed luminaire and a pair of telescoping bars for attaching the plaster frame to framing support members. The telescoping bars include a first bar and a second bar, each of the bars having a generally S-shaped cross-sectional profile that is defined by a center curve joining a first area and a second area, which are generally hook-shaped and extend perpendicularly from the center curve in opposing directions. The first area of the first bar is overlappingly positioned at least in part within the second area of the second bar, and the first area of the second bar is overlappingly positioned at least in part within the second area of the second bar whereby the first and second bars are mated in an inverted and opposed adjacent relationship allowing sliding extension of the bars.

20 Claims, 8 Drawing Sheets

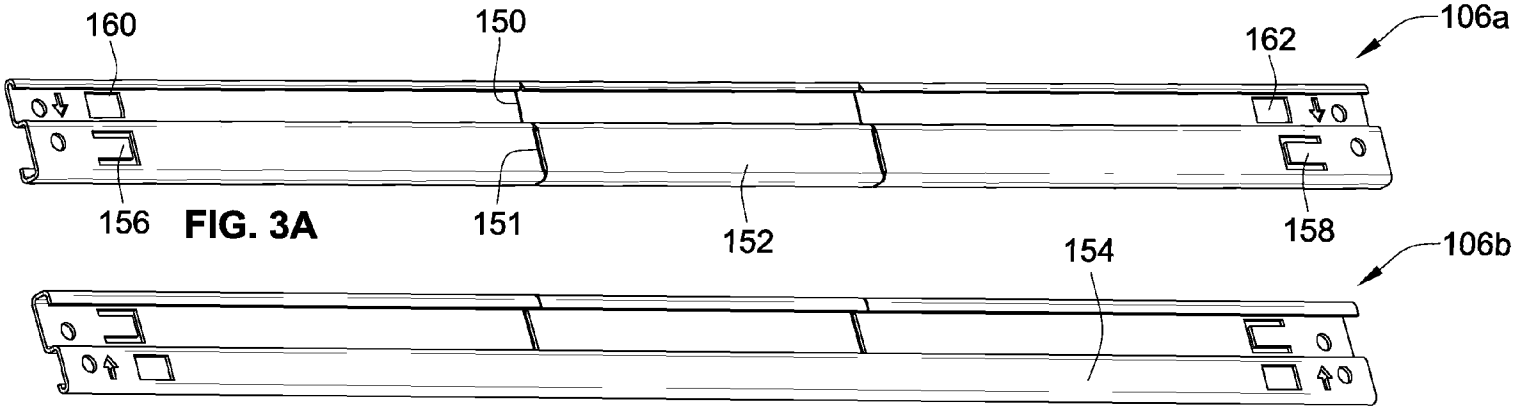
FIG. 3A
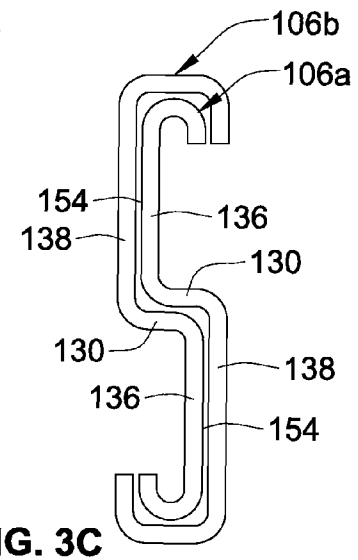
FIG. 3B
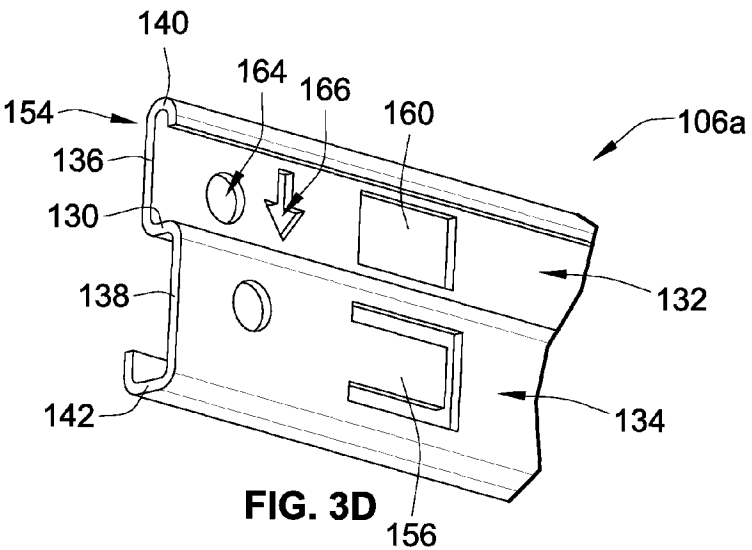
FIG. 3D
FIG. 3C

TELESCOPING MOUNTING SYSTEM FOR A RECESSED LUMINAIRE

FIELD OF THE INVENTION

This invention is directed generally to mountings systems, and, more particularly, to a telescoping system for mounting a recessed luminaire to a building structure.

BACKGROUND OF THE INVENTION

Typically, prior to installation of a finished ceiling, a recessed luminaire (also referred to as a light fixture) is secured to wood and/or steel framing of a building using telescoping bars that cover common spacing between parallel framing members. For example, the telescoping bars cover a joist spacing in the range of about 16 inches-24 inches or a T-bar spacing in the range of about 24 inches.

After attachment to the building framing, the recessed luminaire can be adjusted perpendicular to the framing members by sliding it along the telescoping bars. The telescoping bars generally require two distinct members—a male member and a female member—to form a telescoping assembly. As such, having to manufacture and install two separate components (i.e., members) for the telescoping assemblies unnecessarily increases tooling expenditure, components cost, and inventory handling. Thus, usage of present telescoping assemblies results in decreased profits and operations efficiency.

Another problem with typical telescoping bars is that they tend to have cross-sectional shapes of low strength and rigidity. For example, some telescoping bars have a generally U-shape that tends to flex in an impeding manner (e.g., in a direction perpendicular to the adjustment direction) when attempting to adjust the telescoping bars. In addition, typical telescoping bars are manufactured using processes that result in scrap material, resulting in material waste and increased manufacturing costs.

Certain telescoping assemblies also include free-sliding components that facilitate a sliding (or telescoping) motion of the telescoping bars. However, the free-sliding components have the potential to cause binding, damage, and/or injury during the handling, installation, and/or adjustment of the telescoping bars. Furthermore, the free-sliding components tend to increase the perception that the telescoping assembly is made of poor quality.

Some telescoping assemblies also include mounting feet having joist alignment flanges for aiding in aligning the telescoping assembly to the framing members during the installation procedure. However, end users commonly complain that these joist alignment flanges interfere with adjacent ceiling tiles.

Yet another problem with current joist alignment flanges is that often the surface of the alignment flange is not in intimate contact with a bottom surface of a joist when driving in a fastening nail or screw. As such, undesired rotational movement of the respective mounting foot can result.

Similar problems may also be present in installation of other devices that are similarly installed to the building framing. Such devices may include audio speakers, recessed fans, electrical boxes, etc.

What is needed, therefore, is a telescoping assembly for a recessed luminaire mounted to a building framing that addresses the above-stated and other problems.

SUMMARY OF THE INVENTION

In an implementation of the present invention, a telescoping mounting system improves installation and adjustment between a recessed luminaire and a framing structure. The mounting system includes two telescoping bars having a generally identical S-shaped cross-sectional profile. The S-shaped profile allows both telescoping bars to function as either the "male" member or the "female" member of the mounting system by simply changing the orientation of the telescoping bars. For example, with both telescoping bars being in identical positions, one of the bars is rotated 180° about a horizontal axis to facilitate engagement between the bars. The telescoping bars can be manufactured using a cold rolling process to eliminate scrap material.

The mounting system further includes a plurality of mounting guides molded from a plastic material and having a geometry designed to clamp tightly around the telescoping bars and secure each mounting guide to a plaster frame. Each of the mounting guides has two opposing sides connected by a flexible hinge, which allows a snapping connection of the mounting guides to the plaster frame. Each of the opposing sides has an internal surface that interfaces with the S-shaped bars.

In alternative implementations of the above invention, the mounting system includes mounting feet attached to the end of the S-shaped telescoping bars. The mounting feet include one or more features directed to improving functionality, especially when they are mounted to a T-bar grid ceiling. The features include one or more supplemental locking features that prevent unintentional or undesired detachment from the framing structure; features that allow easy field removal of areas of the mounting feet that can interfere with adjacent ceiling tiles; a combination nail-form and T-bar clamp that improves the connection between the mounting feet and the T-bar; and/or anti-rotation features intended to prevent unintended rotational movement of the mounting feet when a surface of the alignment flange is not in intimate contact with a joist surface.

In an alternative implementation of the present invention, a lighting assembly for a recessed luminaire includes a plaster frame for supporting the recessed luminaire and a pair of telescoping bars for attaching the plaster frame to framing support members. The telescoping bars include a first bar and a second bar, each of the bars having a generally S-shaped cross-sectional profile that is defined by a center curve joining a first area and a second area of the cross-sectional profile. The first area of the first bar is overlappingly positioned at least in part within the second area of the second bar, and the first area of the second bar is overlappingly positioned at least in part within the second area of the second bar.

In another alternative implementation of the present invention, a lighting assembly for a recessed luminaire includes a plaster frame for supporting the recessed luminaire. The lighting assembly further includes four cutouts, including a first pair of attachments positioned along a first edge of the plaster frame and a second pair of attachments positioned along a second edge of the plaster frame. A first pair of mounting guides is secured correspondingly to the first pair of cutouts, and a second pair of mounting guides is secured correspondingly to the second pair of cutouts. Each of the mounting guides is made from a molded plastic material and includes a flexible hinge that joins two opposing parallel sides. A first pair of telescoping bars is slidably mounted to the plaster frame via the first pair of mounting guides, and a second pair of telescoping bars is slidably mounted to the plaster frame via the second pair of mounting guides. Each of the telescoping bars is identical to each other and has a generally S-shaped cross-sectional profile. A first pair of mounting feet is mounted correspondingly to each end of the first pair of telescoping bars, and a second pair of mounting feet is mounted correspondingly to each end of the second pair of telescoping bars.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings.

FIG. 3A is a perspective view of a first S-shaped telescoping bar.

FIG. 3B is a perspective view of a second S-shaped telescoping bar.

FIG. 3C is a side view showing assembled profile of the first and second S-shaped telescoping bars.

FIG. 3D is a partial enlarged perspective view of the second S-shaped telescoping bar.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
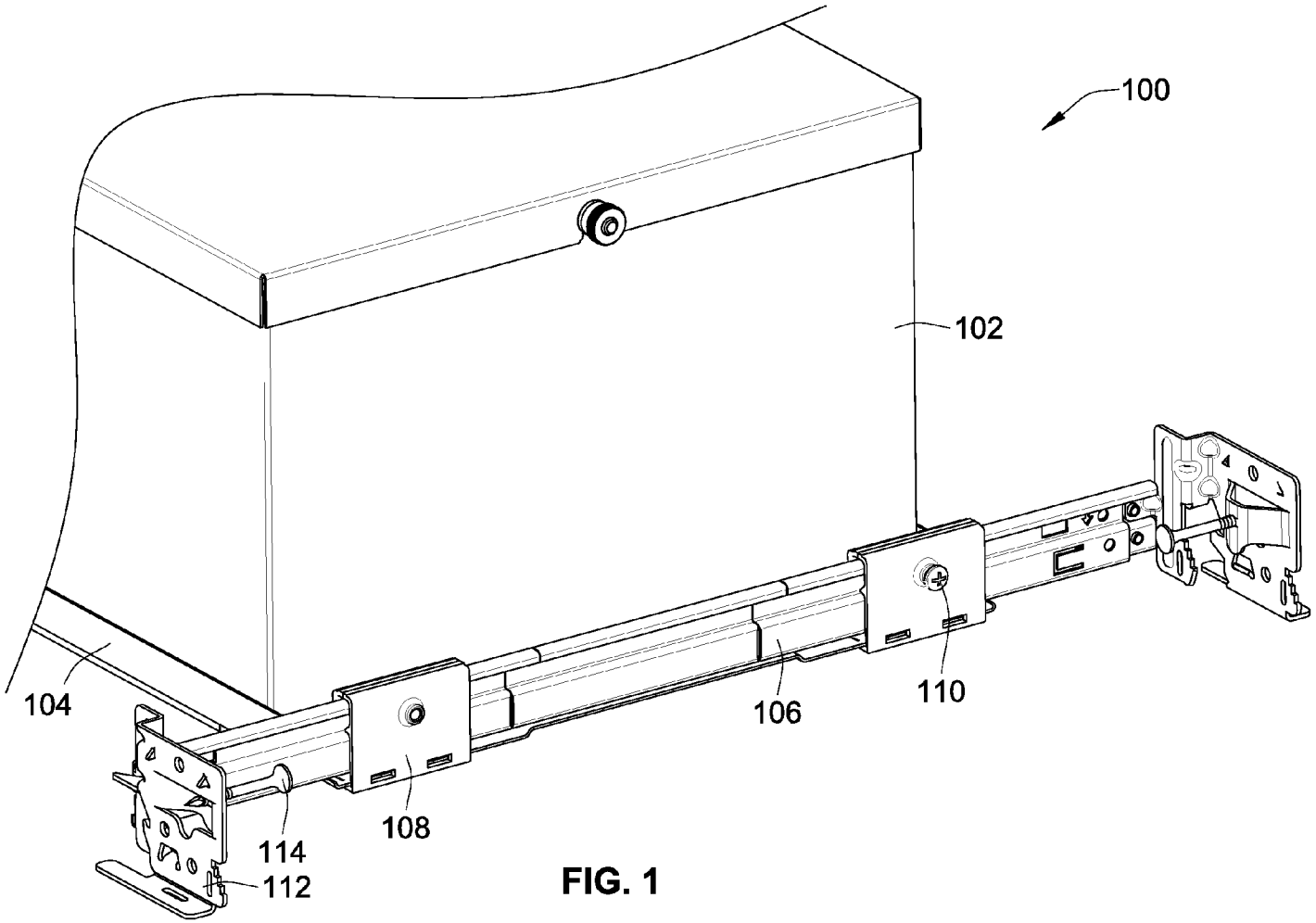
FIG. 1 is a partial top front perspective view of a recessed luminaire.

Referring to FIG. 1, a recessed fixture in the form of a recessed luminaire 100 includes a luminaire housing 102 and a mounting assembly including a plaster frame 104 and a pair of telescoping bars 106. In other embodiments the recessed fixture can also be, for example, an audio speaker, an electrical fan, or an electrical box.

The telescoping bars 106 are attached to the plaster frame 104 using a pair of mounting guides 108. A locking screw 110 is used, generally, as a set screw to prevent motion of the bars 106 relative to the mounting guide 108. The telescoping bars 106 are rigidly attachable to a building structure using a pair of mounting feet 112, which are attached at each end of the telescoping bars 106.

Figure 7A:
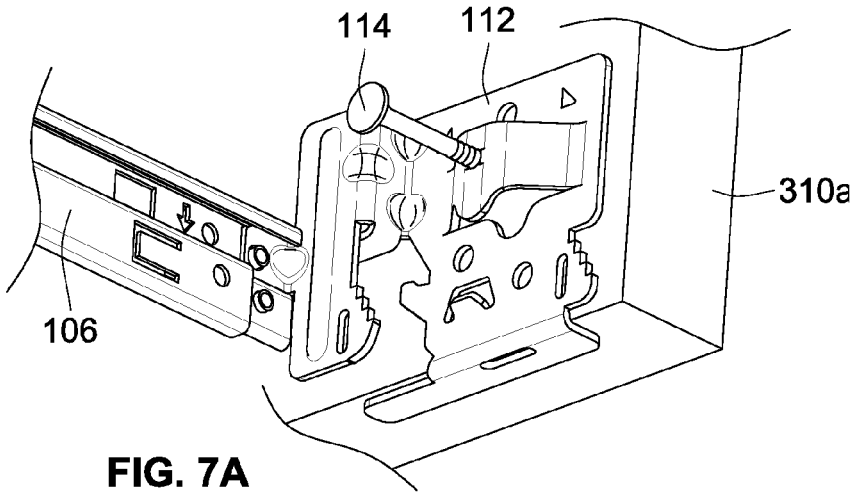
FIG. 7A is a lower front perspective view illustrating attachment of the mounting foot to a wood framing member.
Figure 7B:
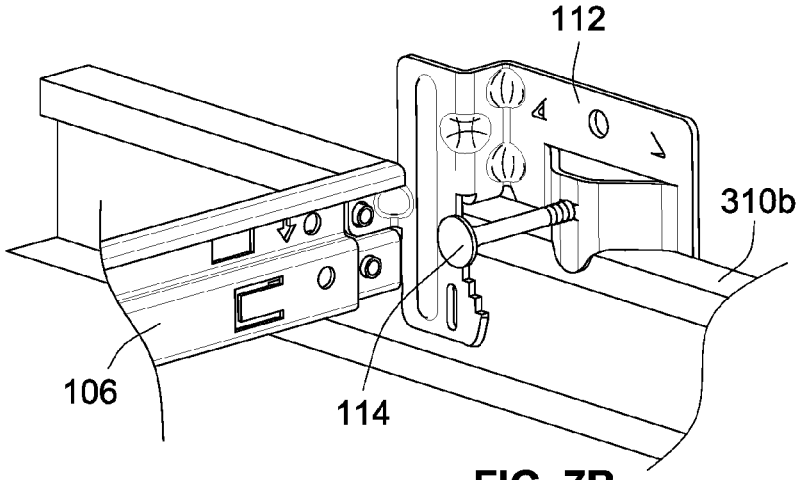
FIG. 7B is a front perspective view illustrating attachment of the mounting foot to a T-Bar framing member.
Figure 7C:
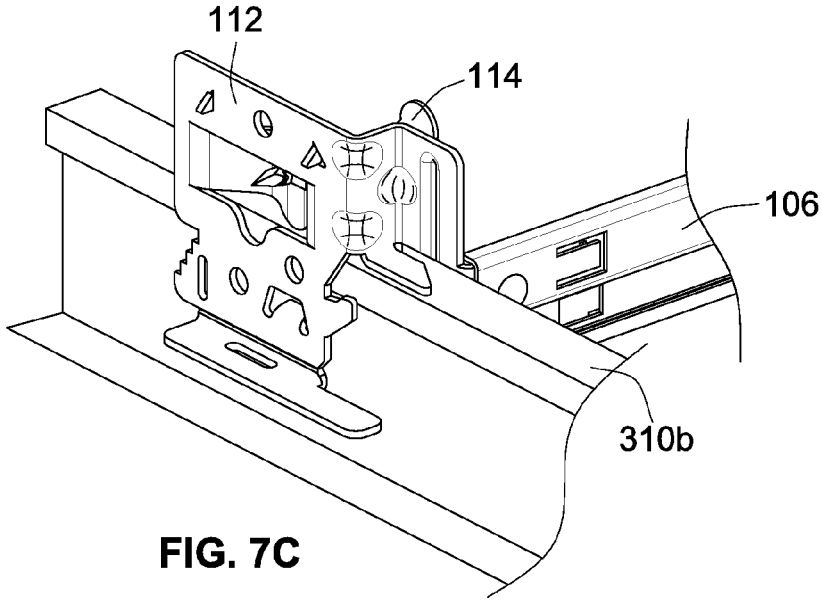
FIG. 7C is an upper back perspective view illustrating the attachment of the mounting foot to the T-Bar framing member.

The building structure typically includes structural framing members such as a wood framing member 310*a* (shown in FIG. 7A) and/or a steel framing member 310*b* (shown in FIGS. 7B and 7C). The framing members (collectively identified as framing members 310) are separated by a distance commonly referred to as a joist spacing (typical in wood framing members) or a T-Bar spacing (typical in steel framing members having a T-Bar cross-sectional shape). Prior to installation of a finished ceiling (or other covering surface), a fastener 114, such as a nail or screw, is used to attach the mounting feet 112 to the framing members 310.

Figure 2A:
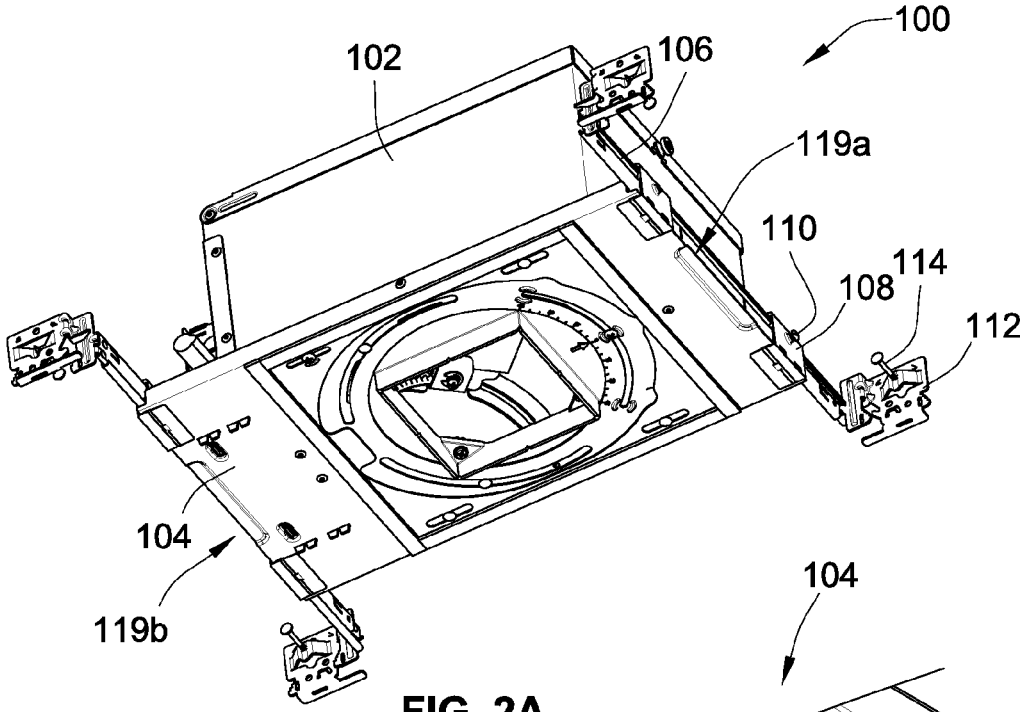
FIG. 2A is a full bottom front perspective view of the recessed luminaire.

Referring to FIG. 2A, a typical assembly of the recessed luminaire 100 includes a total of two pairs of telescoping bars 106 (one pair per side), two pairs of mounting guides 108 (one pair per side), two pairs of mounting feet 112 (one pair per side), a single plaster frame 104, and at least two locking screws 110 (at least one per side). The plaster frame 104 is a base support plate that can be an integral part of the recessed luminaire 100 or a separate removable part, and has a first edge 119*a* and a second edge 119*b* (which are generally parallel to each other). The plaster frame 104 can be constructed of formed sheet steel in various length and width combinations per the overall luminaire size requirements. The plaster frame is so called because it is typically adapted to receive plaster for finishing the ceiling surface once the recessed light fixture/luminaire and the ceiling plane have been installed.

Figure 2B:
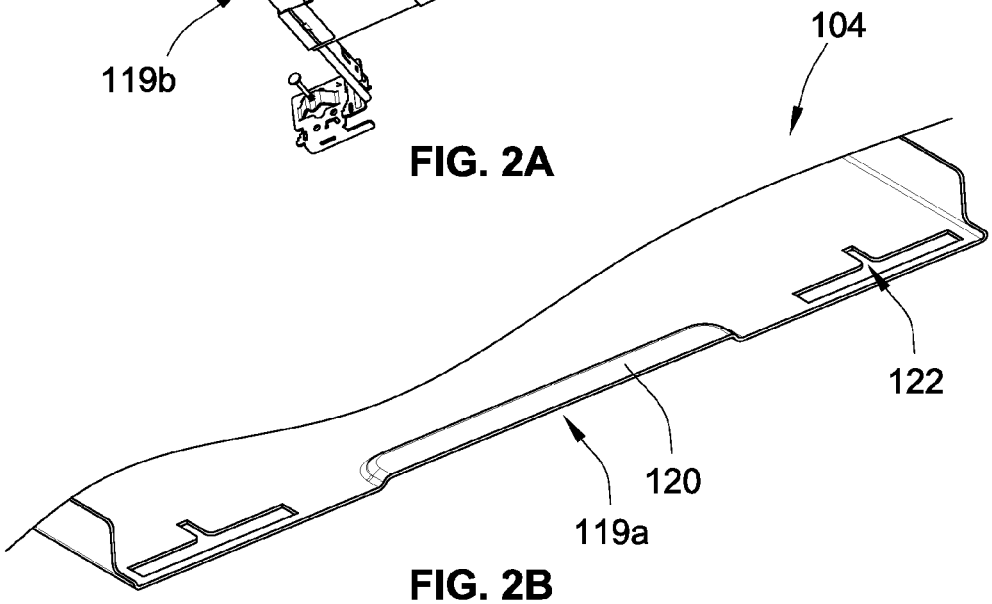
FIG. 2B is a partial perspective of a plaster frame.
Figure 2C:
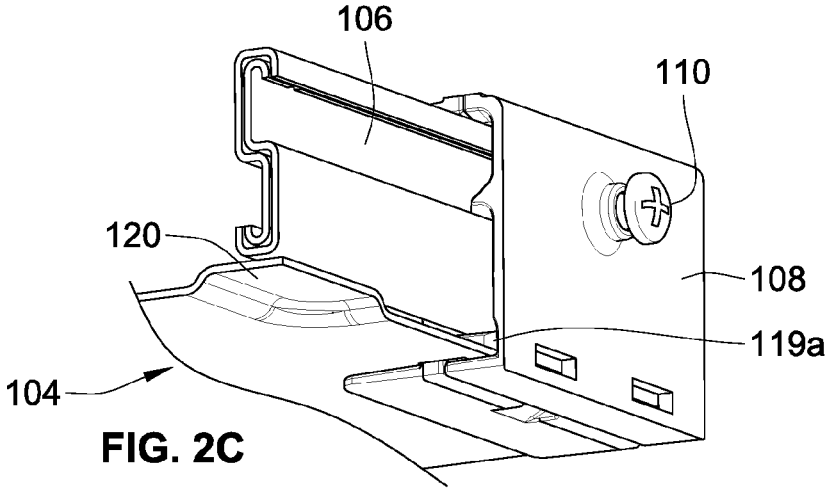
FIG. 2C is a partial perspective of a mounting guide assembled to the plaster frame and to S-shaped telescoping bars.

Referring to FIGS. 2B and 2C, the plaster frame 104 is a generally rectangular plate having an embossed rib 120 for supporting the telescoping bars 106. The embossed rib 120 is generally an indentation rising up from a generally flat area of the plaster frame 104 to make contact with the telescoping bars 106. As illustrated in FIG. 2B, the embossed rib 120 is located along the first edge 119*a* of the plaster frame 104 in a centrally located position.

Also, by way of illustration for both edges, along the first edge 119*a* the plaster frame 104 has cutouts 122 for attachment of the mounting guides 108. The cutouts 122 are located near each end of the first edge 119*a* and have a size and shape adapted for receiving a respective mounting guide 108. The plaster frame 104 includes a similar embossed rib and cutouts along the second edge 119*b*.

Referring to FIGS. 3A-3D, the telescoping bars 106 include a first bar 106*a* and a second bar 106*b*, each bar being identical to each other and having an S-shaped constant profile. The telescoping bars 106 are designed such that a single profile can be used two times in each telescoping assembly of bars 106. In other words, the gender (e.g., male/female or left/right) of the bars 106 is controlled simply by changing the orientation of the bars 106 based on the unique S-shaped profile. The S-shaped bars 106 have the potential to reduce tooling expenditure, lower component costs, and reduce inventory handling, which can result in increased profits and improved efficiency in operations. Another advantage of the S-shaped profile is that it provides sufficient stiffness to eliminate undesirable vertical bending of the bars 106. For ease of understanding, the description below will generally refer to a single bar (e.g., to the first bar 106*a*). However, it is understood that the description applies equally to both bars.

The S-shaped profile, best seen in FIGS. 3C and 3D, is defined by a center curve 130 that joins a first area 132 with a second area 134. When assembled, the first area 132 of the first bar 106*a* is overlappingly positioned at least in part within the second area 134 of the second bar 106*b*, and the first area 132 of the second bar 106*b* is overlappingly positioned at least in part within the second area 134 of the first bar 106*a*.

The first area 132 includes a first lateral side 136 that extends generally perpendicular away from a first end of the center curve 130. Similarly, the second area 134 includes a second lateral side 138 that extends generally perpendicular away from a second end of the center curve 130. The second lateral side 138 extends in an opposite direction than the first lateral side 136. The second end of the center curve 130 is opposite to the first end.

The lateral sides 136, 138 are each generally hook-shaped and join with the center curve 130 to form the general S-shape profile of the telescoping bars 106. The first area 132 further includes a smaller C-shape profile 140 at the end of the first lateral side 136 and a larger C-shape profile 142 at the end of the second lateral side 138. When assembled, the smaller C-shape profile 140 of one bar fits within the larger C-shape profile 142 of another bar for telescoping movement of the telescoping bars 106 relative to each other. Specifically, when adjusting the telescoping bars 106 relative to each other, the smaller C-shape profile 140 slides along and within the larger C-shape profile 142.

The telescoping bar 106*a* further includes at least one score line 150 and score notch 151 located transversally along the length of the bars 106 to allow shortening of the bars 106 when necessary. The score line 150 is a partially cut line of weakness on one side of the bars 106 that facilitates, along with the score notch 151, easy removal (e.g., by manually bending and removing) of a sectional length 152 of the bars 106.

The telescoping bar 106*a* is typically made from formed sheet steel and can have a length, thickness, and cross-sectional profile that can be changed to meet an end use application without affecting design intent. The telescoping bars 106 are preferably made from a cold-rolled steel material via a roll forming process because it eliminates generation of scrap material. For example, in contrast to a progressive die stamping process, roll forming does not require excess material to carry the telescoping bars 106 through a tool.

The telescoping bar 106*a* has a flat uninterrupted surface 154 for achieving a smooth feel with slight tension of the telescoping assembly. The smooth feel and slight tension is further achieved using formed left and right tabs 156, 158, respectively, in conjunction with left and right tab notches 160, 162. The tabs 156, 158 are formed inward in a rectangular shape to provide tension between the assembled telescoping bars 106, and to act in conjunction with a respective tab notch 160, 162 (also rectangular in shape) to prevent disengagement of the telescoping bars 106 at the end of the bar span. For example, a left tab 156 of the first telescoping bar 106*a* is received within the left tab notch 160 of the second telescoping bar 106*b*, and the right tab 158 of the first telescoping bar 106*a* is received within the right tab notch 162 of the second telescoping bar 106*b*.

Optionally, specific placement of the tabs 156, 158 and corresponding tab notch 160, 162 can help control the dimension of the expanded mounting assembly for simple mounting in various applications. The telescoping bar 106*a* further includes a plurality of holes 164 for mechanically securing the mounting feet 112 and indicator arrows 166 for correct alignment with the mounting feet 112.

Figure 4B:
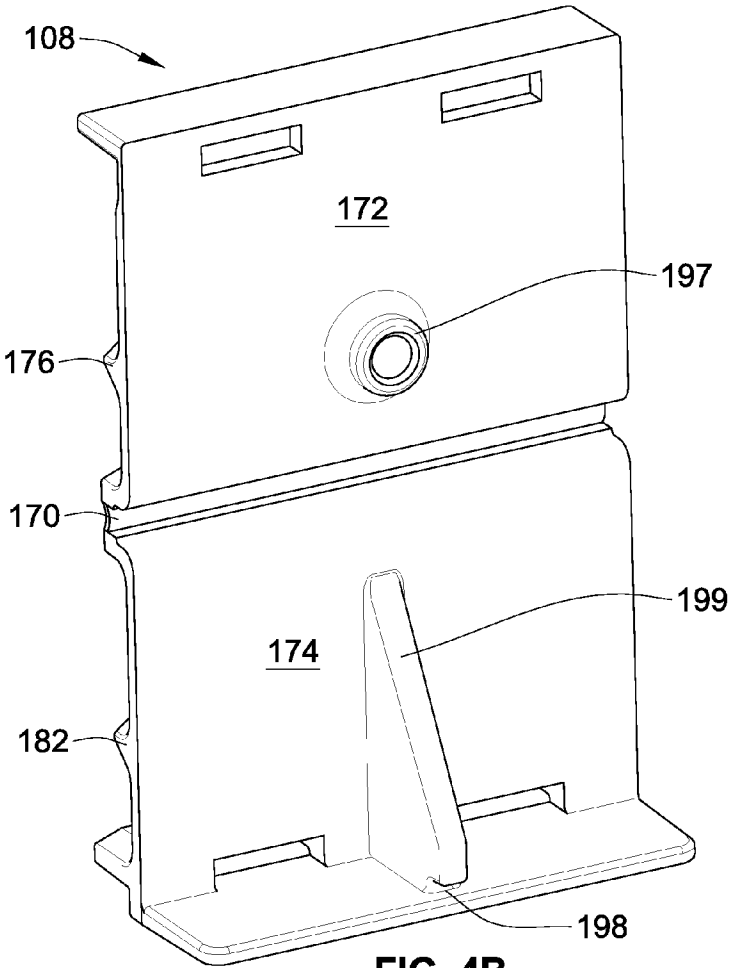
FIG. 4B is a perspective view of exterior surfaces of the mounting guide.
Figure 4A:
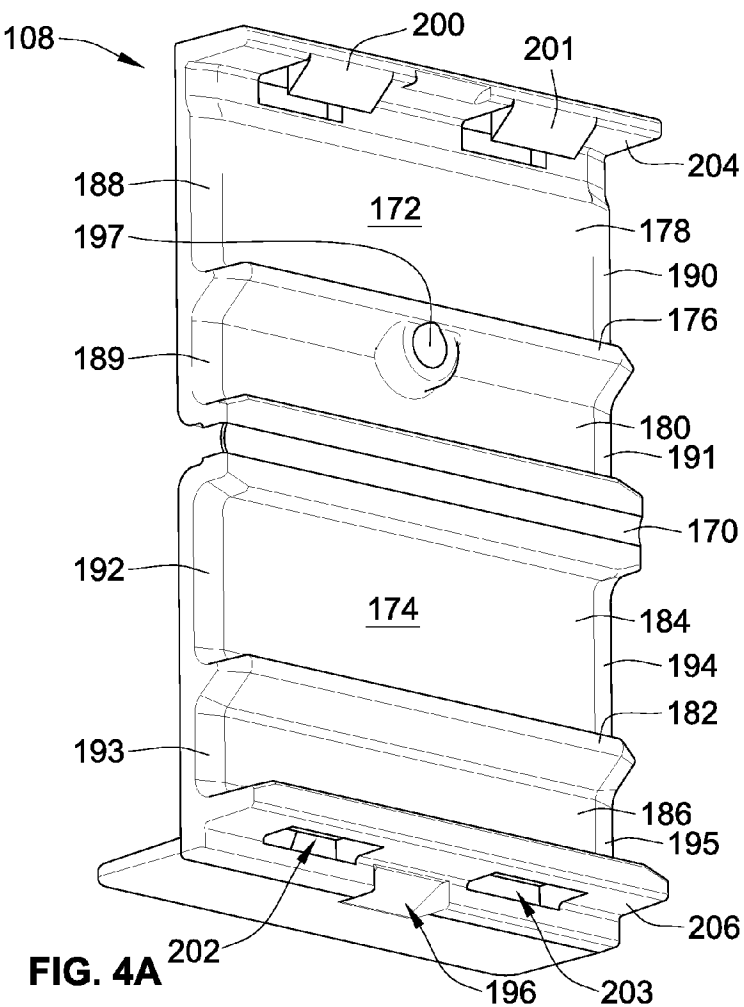
FIG. 4A is perspective view of interior surfaces of a mounting guide.

Referring to FIGS. 4A and 4B, the mounting guide 108 is made from a molded plastic material, which is preferably manufactured using an injection molding of a plastic material. The injection molding manufacturing process allows molding the unique geometry of the mounting guide 108 for interfacing with the S-shaped telescoping bars 106 and for combining several features into a single part. Furthermore, the use of a plastic material reduces friction and improves the sliding fit between the telescoping bars 106 and the molded mounting guide 108.

The mounting guide 108 includes a hinge 170 that flexibly connects a first hinge part 172 to a second hinge part 174. The first part 172 has an internal central ridge 176 that separates a large mating surface 178 from a small mating surface 180. The second part 174 has a similar internal central ridge 182 that separates a large mating surface 184 from a small mating surface 186. When assembled, the mating surfaces 178, 180, 184, 186 slidably engage surfaces of the telescoping bars 106.

To facilitate ease of engagement between the mounting guide 108 and the telescoping bars 106, lead-in surfaces 188-191 are provided along each engaging edge of the first part 172 and lead-in surfaces 192-195 are provided along each engaging edge of the second part 174. The lead-in surfaces 188-195 have a beveled shape for providing a smooth point of entry and mating interface between the telescoping bars 106 and the mounting guide 108.

Other features of the mounting guide 108 include a release notch 196, a locking screw boss 197, a plaster frame clearance notch 198, and a strengthening and attachment rib 199. The release notch 196 is helpful in releasing or detaching the mounting guide 108 from the plaster frame 104 (if disassembly is required). A tool, such as a screwdriver tip can be inserted into the release notch 196 to release the mounting guide 108.

The locking screw boss 197 is adapted to receive the locking screw 110 for locking in position movement of the telescoping bars 106 relative to the mounting guide 108. As the locking screw 110 protrudes within the mounting guide 108 through the locking screw boss 197, the locking screw 110 makes contact with the telescoping bars 106 and applies a retaining frictional force to the telescoping bars 106 to prevent motion relative to the mounting guide 108. The strengthening and attachment rib 199 provides rigidity to the mounting guide 108, e.g., preventing or reducing unintended flexure of the mounting guide 108.

The mounting guide 108 further includes a pair of integral snaps 200, 201 and a pair of snap catches 202, 203. The snaps 200, 201 are positioned along a first frame surface 204 of the first part 172, and the snap catches 202, 203 are positioned along a second frame surface 206 of the second part 174. As described in more detail below, the snaps 200, 201, and the snap catches 202, 203 fix the mounting guide 108 to the plaster frame 104.

Figure 5B:
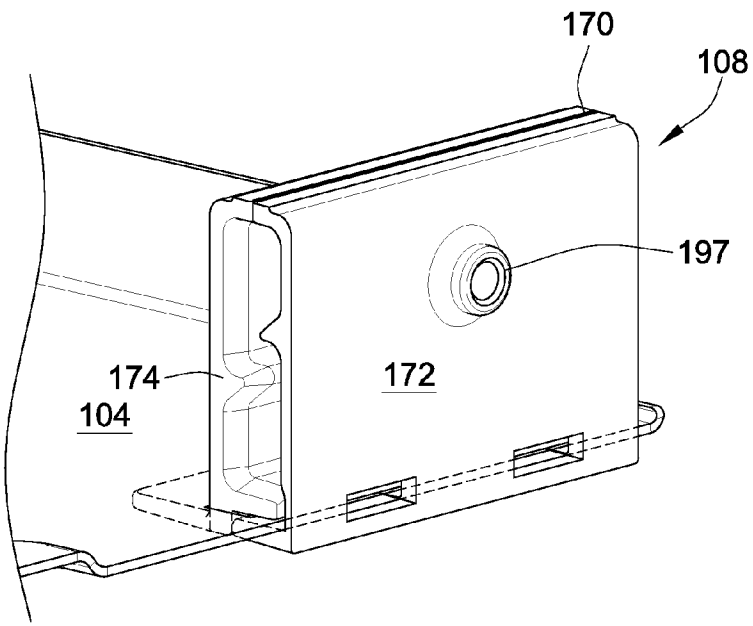
FIG. 5B is a perspective view illustrating the mounting guide after being secured to the plaster frame.
Figure 5A:
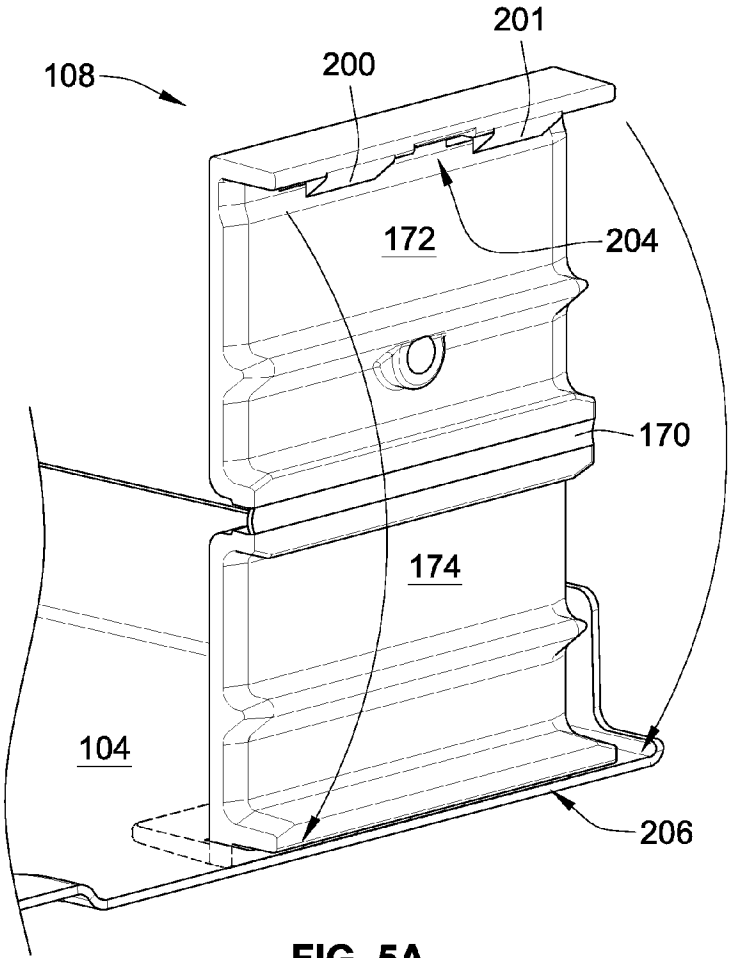
FIG. 5A is a perspective view illustrating the mounting guide prior to being secured to the plaster frame.

Referring to FIGS. 5A and 5B, the mounting guide 108 is mechanically attached to the plaster frame 104 by moving the first part 172 in parallel position with the second part 174 and inserting the snaps 200, 201 into the snap catches 202, 203. Specifically, the flexible hinge 170 allows the first part 172 to snap shut parallel to the second part 174 with the plaster frame 104 interposed between the first frame surface 204 of the first part 172 and the second frame surface 206 of the second part 174.

Figure 5C:
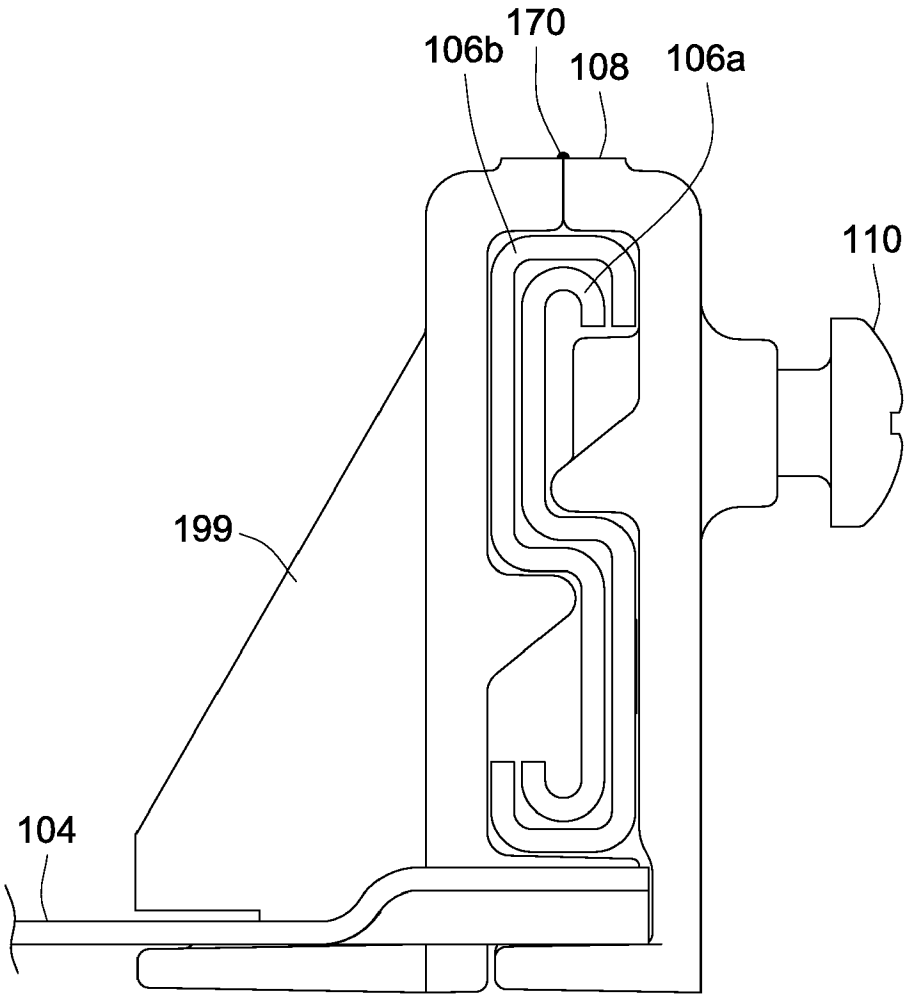
FIG. 5C is a side view illustrating the mounting guide and the S-shaped telescoping bars assembled to the plaster frame.

Referring to FIG. 5C, the mounting guide 108 is in a snapped closed position secured to the plaster frame 104 such that the first and second telescoping bars 106*a*, 106*b* are captured on four sides by the mounting guide 108. Specifically, the first and second telescoping bars 106*a*, 106*b* interface with the mounting guide 108 along the mating surfaces 178, 180, 184, 186 (which are clearly displayed in FIG. 4A), and the internal central ridges 176, 182 interface respectively with the center curve 130 of the telescoping bars 106. The locking screw 110 locks the telescoping bars 106 in position relative to the mounting guide 108 telescoping bars 106, with the telescoping bars 106 being inserted within the mounting guide 108.

The interface between the mounting guide 108 and the telescoping bars 106 is advantageous because it maintains the luminaire in the same vertical position when adjusting along the span of the telescoping bars 106 and because it eliminates binding of the luminaire when transitioning from the first telescoping bar 106*a* to the second telescoping bar 106*b* (or vice versa). Thus, the interface eliminates undesirable vertical motion of the recessed luminaire 100, which is common to various current products in the industry. The lead-in surfaces 188-195 are also helpful in easing transitioning from the first telescoping bar 106*a* to the second telescoping bar 106*b* (or vice versa) or when inserting the telescoping bars 106 for the first time.

Another advantage of the interface between the mounting guide 108 and the telescoping bars 106 is that a slight amount of friction is provided between the mounting guide 108 and the telescoping bars 106. This friction helps maintain the position of the telescoping bars 106 during handling and installation.

A smooth-sliding (fluid) action is achieved between the first telescoping bar 106*a* and the second telescoping bar 106*b*, and between the telescoping bars 106 and the mounting guide 108. This smooth-sliding action eliminates free-sliding components, which have the potential to cause binding, damage, and/or injury during handling, installation, and adjustment. Furthermore, the smooth-sliding action improves the perception of quality regarding the recessed luminaire 100.

Figure 6A:
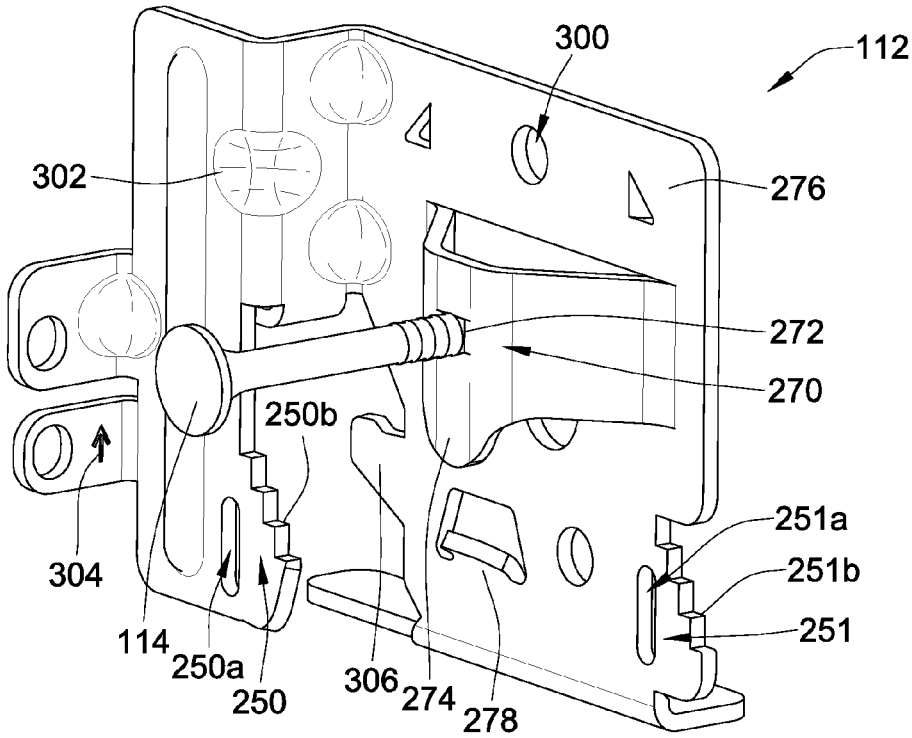
FIG. 6A is a front perspective view of a mounting foot.
Figure 6B:
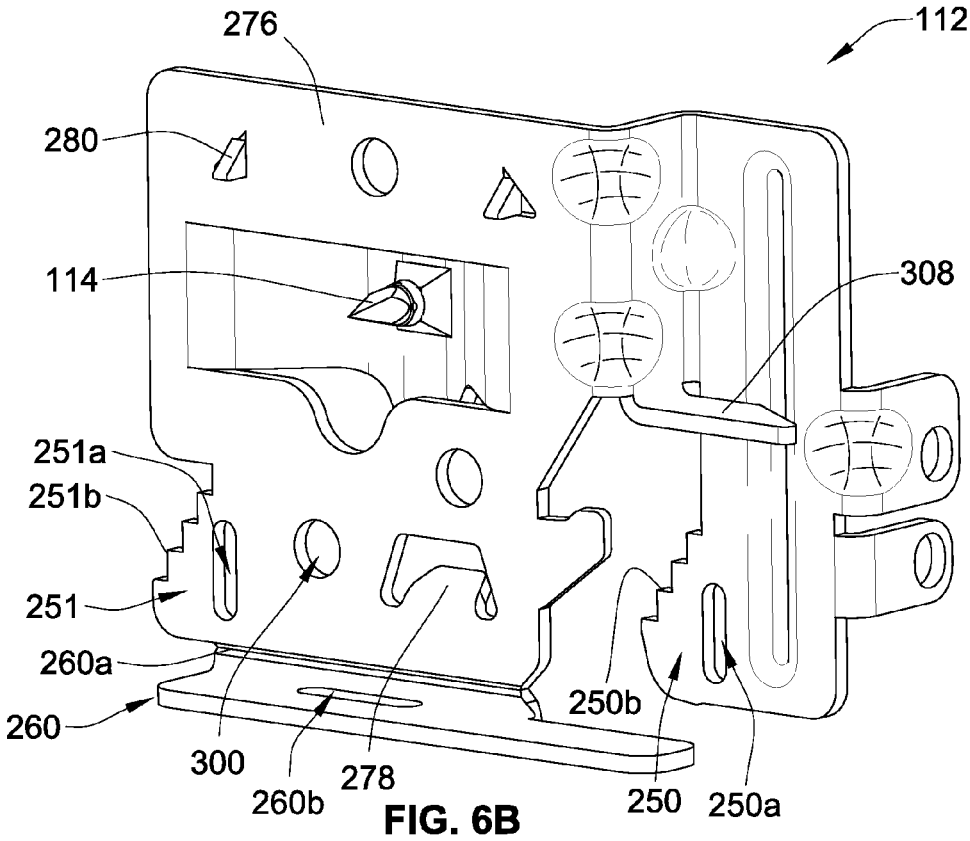
FIG. 6B is a back perspective view of the mounting foot.

Referring to FIGS. 6A and 6B, the mounting foot 112 is manufactured from a sheet steel material and is mechanically attached to the ends of the telescoping bars 106 to facilitate securing the luminaire to the building structure. The mounting foot 112 has two locks 250, 251 that include a lock slot 250*a*, 251*a* and a stepped surface 250*b*, 251*b*. To fix the mounting foot 112 in position to a T-Bar framing member 310*b*, a screwdriver tip can be inserted into the lock slot 250*a*, 251*a* to bend the lock 250, 251 inwards such that the stepped surface 250*b*, 251*b* is firmly in contact with the T-Bar framing member 310*b*. Thus, the locks 250, 251 prevent detachment of the mounting foot 112 from the T-Bar framing member 310*b*.

The mounting foot 112 includes a break-away joist alignment flange 260 having a flange score line 260*a* and a flange slot 260*b*. The flange 260 can be removed from the mounting foot 112 by inserting a screwdriver tip into the flange slot 260*b* and applying force. The applied forces separates the flange 260 from the mounting foot 112 along the flange score line 260*a*. For example, the flange 260 may be useful for alignment purposes when attaching the mounting foot 112 to a wood framing member 310*a*, but may interfere with installation of ceiling tiles when attaching the mounting foot 112 to a T-Bar framing member. In fact, a common complaint by end users is that this type of flange interferes with adjacent ceiling tiles in T-Bar ceilings. Thus, the flange 260 can be removed after attaching the mounting foot 112 to the T-Bar framing member 310*b* (FIG. 7B).

The mounting foot 112 includes a dual-attachment feature for attaching the mounting foot 112 to either a wood framing member 310*a* (FIG. 7A) or a T-Bar framing member 310*b*. The attachment feature is a nail form 270 (FIG. 6A) having a nail hole 272 and a clip tab 274. The nail form 270 extends away from a main wall 276 of the mounting foot 112. The fastener 114 is inserted through the nail hole 272 to secure in place the mounting foot 112 to a building structure, such as a wood framing member 310*a*. The clip tab 274 overlaps a T-Bar type of framing member (shown in FIG. 7B) to ease attachment and positioning of the mounting foot 112 relative to the framing member 310.

In addition to the clip tab 274, the mounting foot 112 includes a T-Bar clip 278 that extends inwards from the main wall 276 in the same direction as the nail form 270. The T-Bar clip 278 is another feature that helps maintain the mounting foot 112 in position relative to a T-Bar framing member 310*b*.

The mounting foot 112 includes anti-rotation barbs 280 on an external (or back) surface of the main wall 276. During installation, if the surface of the alignment flange 260 is not in intimate contact with the bottom of the joist when driving in the nail or screw, rotational movement of the mounting foot 112 can result, which is undesirable. The anti-rotation barbs 280 are inserted into a wood framing member 310*a* to prevent undesired rotation of the mounting foot 112 relative to the framing member 310 during and after driving the nail or screw. Thus, the anti-rotation barbs 280 provide a more secure and rigid installation of the recessed luminaire 100.

Other features of the mounting foot 112 include auxiliary mounting holes 300, strengthening features 302, a telescoping bar alignment indicator 304, a tension leg 306 (for T-Bar construction), a support leg 308 (for T-Bar construction). Each of these features can be helpful in providing a simpler and efficient manner of installing the recessed luminaire 100 to the building structure.

Referring to FIGS. 7A-7C, the mounting foot 112 can be attached to either the wood framing member 310*a* or the T-Bar framing member 310*b*. The features descried above facilitate attachment to either type of framing member, or to similar framing members.

While particular embodiments, aspects, and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A mounting assembly for a recessed fixture, the mounting assembly comprising:

a plaster frame for supporting the recessed fixture; and a pair of telescoping bars for attaching the plaster frame to framing support members, the telescoping bars including a first bar and a second bar, each of the telescoping bars having a generally S-shaped cross-sectional profile that is defined by a center curve joining a first area and a second area, each of the first and second areas being generally hook-shaped and extending perpendicularly from the center curve in opposing directions, the first area of the first bar being overlappingly positioned at least in part within the second area of the second bar, the first area of the second bar being overlappingly positioned at least in part within the second area of the first bar whereby the first and second bars are mated in an inverted and opposed adjacent relationship allowing sliding extension of the bars.

2. The mounting assembly of claim 1, wherein the telescoping bars are identically shaped.

3. The mounting assembly of claim 1, wherein each of the telescoping bars has a tab notch and a tab for providing tension and preventing disengagement between the first bar and the second bar, the tab of the first bar being received within the tab notch of the second bar and the tab of the second bar being received within the tab notch of the first bar.

4. The mounting assembly of claim 1, further comprising a pair of mounting guides secured in place to the plaster frame for attaching the telescoping bars to the plaster frame, each of the mounting guides having two opposing parts, the opposing parts having mating surfaces that are in contact with the telescoping bars.

5. The mounting assembly of claim 4, wherein one of the mounting guides has a hinge joining its two opposing parts.

6. The mounting assembly of claim 5, wherein the hinge is made of a flexible material.

7. The mounting assembly of claim 6, wherein each of the opposing parts of the mounting guides has a central ridge extending inward to interface with a respective center curve of the telescoping bars.

8. The mounting assembly of claim 6, wherein the mounting guides are made from a molded plastic material.

9. The mounting assembly of claim 4, wherein the mounting guides have lead-in surfaces along interface edges of the opposing parts, the lead-in surfaces having a beveled edge for providing a smooth mating interface between the telescoping bars and the mounting guides.

10. The mounting assembly of claim 1, wherein the telescoping bars are made from a cold-rolled metal.

11. The mounting assembly of claim 1, further comprising a mounting foot attached to each end of the telescoping bars and being attachable to a member of the framing support members, the member being a T-bar member, the mounting foot including at least one lock feature having a bendable side that engages the T-bar member when bent inwards to prevent detachment of the mounting foot.

12. The mounting assembly of claim 1, further comprising a mounting foot attached to each end of the telescoping bars and to a member of the framing support members, the mounting foot including a joist alignment flange having a break-away portion for removing the flange from the mounting foot.

13. The mounting assembly of claim 1, further comprising a mounting foot attached to each end of the telescoping bars and attachable to a member of the framing support members, the mounting foot including a dual-attachment feature for fastening the mounting foot to the framing support members, the dual-attachment feature including a nail form and a clip tab, the nail form extending inward from a main wall of the mounting foot and having a nail hole for receiving a fastener, the clip tab extending from the nail form in a generally parallel direction to the main wall.

14. The mounting assembly of claim 1, further comprising a mounting foot attached to each end of the telescoping bars and to a member of the framing support members, the mounting foot including at least one anti-rotation barb for engaging a wood framing member.

15. A mounting assembly for a recessed luminaire, comprising:

a plaster frame for supporting the recessed luminaire and having four cutouts, the cutouts including a first pair of cutouts positioned along a first edge of the plaster frame and a second pair of cutouts positioned along a second edge of the plaster frame;

a first pair of mounting guides secured correspondingly to the first pair of cutouts and a second pair of mounting guides secured correspondingly to the second pair of cutouts, each of the mounting guides being made from a molded plastic material and including a flexible hinge that joins two opposing parallel parts;

a first pair of telescoping bars slidably mounted to the plaster frame via the first pair of mounting guides and a second pair of telescoping bars slidably mounted to the plaster frame via the second pair of mounting guides, each of the telescoping bars being identical to each other and having a generally S-shaped cross-sectional profile; and a first pair of mounting feet mounted correspondingly to each end of the first pair of telescoping bars and a second pair of mounting feet mounted correspondingly to each end of the second pair of telescoping bars.

16. The mounting assembly of claim 15, wherein each of the first edge and the second edge of the plaster frame has an embossed rib for supporting the corresponding ones of the first pair of telescoping bars and the second pair of telescoping bars.

17. The mounting assembly of claim 15, wherein the telescoping bars are made from a cold-rolled steel material.

18. The mounting assembly of claim 15, wherein each of the mounting guides has a plurality of mating surfaces for interfacing with a corresponding one of the telescoping bars, each of the mating surfaces having at least one lead-in surface having a beveled edge beginning at a respective edge of the mating surfaces.

19. The mounting assembly of claim 15, wherein the first pair of telescoping bars is in frictional contact with the first pair of mounting guides and the second pair of telescoping bars is in frictional contact with the second pair of mounting guides.

20. The mounting assembly of claim 15, wherein each mounting foot of the first pair of mounting feet and the second pair of mounting feet includes at least one of a number of attachment features, including a lock feature having a bendable side that engages a T-bar framing member when bent inwards to prevent detachment of the mounting foot;

a joist alignment flange having a break-away portion for removing the flange from the mounting foot;

a nail form for attaching the mounting foot to a wood framing member, the nail form including a clip for attaching the mounting foot to a T-bar framing member; and a plurality of anti-rotation bars for engaging the wood framing member.

* * * * *